United States Patent [19]

Vukasovich et al.

[11] 4,313,837

[45] Feb. 2, 1982

[54] USING MOLYBDATES TO INHIBIT CORROSION IN WATER-BASED METALWORKING FLUIDS

[75] Inventors: Mark S. Vukasovich, Ann Arbor; Dennis R. Robitaille, Canton, both of Mich.

[73] Assignee: AMAX, Inc., Greenwich, Conn.

[21] Appl. No.: 145,951

[22] Filed: May 2, 1980

[51] Int. Cl.[3] ..... C10M 1/06

[52] U.S. Cl. ..... 252/49.5; 72/42; 252/49.3; 252/49.7; 252/387; 252/389 A; 252/390; 252/391

[58] Field of Search ..... 252/18, 49.3, 49.5, 252/49.7, 387, 389 A, 390, 391

[56] References Cited

U.S. PATENT DOCUMENTS

| | | | |
|---|---|---|---|
| 2,147,395 | 2/1939 | Bayes | 252/5 |
| 2,147,409 | 2/1939 | Lamprey | 252/5 |
| 2,999,064 | 9/1961 | Sluhan | 252/34.7 |
| 3,030,308 | 4/1962 | Agnew et al. | 252/387 X |
| 3,265,620 | 8/1966 | Heiman | 252/33.6 |
| 3,310,489 | 3/1967 | Davis | 252/49.5 X |
| 3,371,047 | 2/1968 | Brunel | 252/49.5 X |
| 3,573,225 | 3/1971 | Kondo et al. | 252/390 X |
| 3,719,598 | 3/1973 | King | 252/49.3 X |
| 3,723,347 | 3/1973 | Mitchell | 252/387 X |
| 3,726,694 | 4/1973 | Moore | 106/14 |
| 3,766,068 | 10/1973 | Tesdahl et al. | 252/49.3 X |
| 3,798,164 | 3/1974 | Kmet et al. | 252/49.5 X |
| 3,874,883 | 4/1975 | Robitaille et al. | 106/14 |
| 3,891,568 | 6/1975 | Nishio et al. | 252/389 A X |
| 3,953,344 | 4/1976 | Narushima | 252/49.5 X |
| 3,983,042 | 9/1976 | Jain et al. | 252/49.5 X |
| 3,992,306 | 11/1976 | Diery et al. | 252/49.3 X |
| 4,017,315 | 4/1977 | Vukasovich et al. | 106/14 |
| 4,138,346 | 2/1979 | Nassry et al. | 252/389 A X |
| 4,149,969 | 4/1979 | Robitaille et al. | 252/181 |
| 4,218,329 | 8/1980 | Koh | 252/46.4 X |

OTHER PUBLICATIONS

Vukasovich et al., "Corrosion Inhibition by Sodium Molybdate", Sep. 1976.

Lipinski et al., "Low Molybdenum-Phosphorus Cooling Water Treatments", Jan. 1978.

Lipinski, "Molybdate Based Cooling Water Treatment", Int'l. Water Conf., Pittsburgh, Pa., Oct. 30-Nov. 1, 1979.

Lui et al., Materials Performance, Sep. 1976, pp. 13-16.

Weisberg, "Chromate and Molybdate Pigments", 1968, Paint and Varnish Production.

Bernhardt et al., Lubrication Eng., vol. 35, Jan. 1979, pp. 36-41.

Fette, Amer. Soc. of Lubrication Eng., 34th Ann. Mtg., 1979, "Sodium Replacement".

Brophy et al., Ind. Eng. Chem., 43, 1951, pp. 884-896.

Oppenheim, Brewers Digest, vol. 52, No. 9, Sep. 1977, pp. 48, 50.

"McCutcheon's Functional Materials-1979 Annual", McCutcheon Division, MC Publishing Co., Glen Rock, N.J., pp. 54-62.

Data Sheet, American Hoechst Co., "Emulsogen B2M".

Data Sheet, The Southland Corp., "Actracor M, Actracor T".

*Primary Examiner*—Andrew Metz

*Attorney, Agent, or Firm*—Michael A. Ciomek; Donald T. Black

[57] ABSTRACT

Corrosion of metal workpieces by water-based synthetic metalworking fluids is inhibited by a small but effective amount of a corrosion inhibitor consisting essentially of a molybdate compound and a compound selected from the group consisting of nitrites, borates, alkanolamines, amine borates, amine salts of unsaturated fatty acids, alkanolamine sarcosinates, alkanolamine phosphates, and alkali, morpholine, and alkanolamine salts of arylsulfonamido carboxylic acids.

3 Claims, No Drawings

USING MOLYBDATES TO INHIBIT CORROSION IN WATER-BASED METALWORKING FLUIDS

BACKGROUND OF THE INVENTION

1. Field of the Invention

This invention relates to metalworking fluids, which are employed during metal machining operations such as drilling, cutting, turning and grinding. The fluid serves to lubricate and cool the tool and workpiece. Heat and friction which can cause severe tool wear and distortion of the workpiece are minimized by the fluid. The fluid also serves to flush chips and particles of metal from the machined area. Typically, these functions are carried out during the machining operation by directing the metalworking fluid onto the surface being machined, whereafter the fluid flows into a reservoir or sump and is recycled by a pump to again impinge onto the metal surface. Metalworking fluids can be nonaqueous oils, oil-water emulsions, and aqueous solutions. The latter two are considered water-based metalworking fluids for the purposes of the present invention.

The conditions under which metal machining operations are carried out favor corrosion of the machined metal surfaces, tooling and other machine elements during and following the machining operation. The risk of corrosion is particularly severe when the metalworking fluid is water-based, that is, an aqueous solution or an oil-water emulsion. For this reason, the water-based metalworking fluids will usually contain small amounts of one or more corrosion inhibitors. In addition to the lubricating, cooling and corrosion-inhibiting functions, the metalworking fluid should possess to as great a degree as possible the following important qualities: it should be usable with all metals it might contact, both ferrous and nonferrous, and it should preferably protect all such metals against corrosion; the fluid should be non-foaming, and any foam formed during use should decay rapidly; the fluid should not be opaque, and it should preferably be transparent so that the machine operator can easily view the work area; the fluid should be useful when subjected to dilution with water of high hardness as well as low hardness content; it should not cause dermatitis or present any other hazards to the health of the machine operator; and preferably it should be disposable by discharge into a sewer.

A widely used corrosion inhibitor for water-based metalworking fluids is a mixture of an alkanolamine such as triethanolamine ("TEA") and a nitrite compound, typically an alkali nitrite such as sodium nitrite. Typically, the TEA is present in the fluid in amounts of about 0.02 to about 0.8 wt. % together with sodium nitrite in amounts from about 0.8 to about 0.02 wt. %, such that the ratio of TEA to sodium nitrite is about 1:40 to about 40:1 by weight.

There is interest in decreasing the necessary concentrations of TEA and nitrites in metalworking fluids while maintaining or improving corrosion inhibition, and there is a need for a corrosion inhibitor to replace the TEA-nitrite corrosion-inhibition system in water-based metalworking fluids. Such a corrosion inhibitor should be readily available, relatively inexpensive and should not pose health or safety hazards.

Some substances have been introduced as alternative corrosion inhibitors to the TEA-nitrite corrosion inhibition system but their corrosion inhibiting effectiveness is generally acknowledged to be less than that of the TEA-nitrite system and they are usually required to be used at higher concentrations for comparable protection of ferrous metals. In addition, some of these alternative corrosion inhibitors do not protect nonferrous metals from corrosion.

2. Description of the Prior Art

The molybdate anion ($MoO_4^{-2}$) has been described to inhibit corrosion in certain applications but the prior art has not recognized or suggested that particular molybdate-based corrosion-inhibiting fluids of the present invention. For instance, molybdates have been disclosed to inhibit corrosion in alcohol-based antifreeze solutions in U.S. Pat. No. 2,147,409, which discloses the utility of 0.05 to 1% of molybdate, and in U.S. Pat. No. 2,147,395, which discloses the utility of 0.05 to 1% of molybdate and 0.05 to 1% of nitrite. Molybdates have also been described as inhibiting corrosion of ore grinding mill liners and balls, and molybdates have been added as corrosion inhibitors to cooling tower waters, hydraulic fluids, and paints. These disclosures do not recognize the particular aspects of the present invention in water-based metalworking fluids.

West German published patent application No. 2,351,274 discloses aqeuous metalworking fluids containing a metallic salt of an anion selected from a list of some 24 different anions. The list includes molybdates and such anions as sulfates, sulfides, bromides, iodides, chlorides, and fluorides. The fluids contain from 1 to 2 wt. % of the anhydrous salt or 1.5 to 6 wt. % of the salt with water of crystallization, and the fluids may also contain from 0.2 to 30 wt. % of corrosion inhibitors such as alkali nitrite or triethanolamine. This disclosure relates only to the cooling function of the fluid, to increase tool life, and does not mention the corrosion inhibiting properties of any of the disclosed fluid component other than the nitrite and triethanolamine, both of which inhibitors are known to the art. Indeed, many of the anions in the disclosed list, such as sulfates, sulfides and halides, are known to be highly corrosive. Thus, their inclusion in a metalworking fluid is unlikely to inhibit corrosion. This disclosure therefore does not suggest any corrosion inhibition by any of the disclosed anions (other than the nitrite) in a water-based metalworking fluid.

SUMMARY OF THE INVENTION

Stated generally, the present invention is a water-based metalworking fluid which inhibits corrosion of metal surfaces which the fluid contacts during a metalworking operation, the fluid containing dissolved therein a small but effective amount to inhibit corrosion of said metal surfaces by said fluid of a corrosion inhibitor consisting essentially of a molybdate compound and one or more compounds selected from the group consisting of nitrites, borates, alkanolamines, amine borates, amine salts of unsaturated fatty acids, alkanolamine sarcosinates, alkanolamine phosphates, and alkali, morpholine, and alkanolamine salts of arylsulfonamido carboxylic acids.

The invention also comprises a process for inhibiting corrosion of a metal surface by a water-based metalworking fluid which contacts the surface while the surface is subjected to a metalworking operation, the process comprising contacting the surface with a water-based metalworking fluid containing dissolved therein a small but effective amount of a corrosion inhibitor consisting essentially of a molybdate compound and one or more compounds selected from the group consisting of nitrites, borates, alkanolamines, amine borates, amine salts of unsaturated fatty acids, alkanolamine sarcosinates, alkanolamine phosphates, and alkali, morpholine, and alkanolamine salts of arylsulfonamido carboxylic acids.

DETAILED DESCRIPTION OF THE INVENTION

As indicated, the present invention comprises a water-based metalworking fluid which inhibits corrosion of the surfaces of metal workpieces, tooling and machine elements during and following metal machining operations such as drilling, cutting, turning and grinding. The invention applies not only to the fluids but also to concentrated formulations which are subsequently diluted by the user to arrive at a fluid of the desired concentration and corrosion-inhibiting activity. Typically, concentrated formulations are prepared which are diluted by about 5:1 to 300:1 by volume with water before use in metalworking operation. The corrosion inhibitor concentrations disclosed herein are those in the fluid as it is ready to use in the metalworking operation.

The invention is applicable to metalworking fluids which are aqueous solutions, and is also applicable to metalworking fluids which are oil-water emulsions such as emulsions in water of about 1 to about 45 wt. % of an oil such as paraffinic or naphthenic mineral oil, sperm oil, lard oil, vegetable fats or oils, and fatty acid esters of animal or vegetable fats or oils, together with optional emulsifying agents such as petroleum sulfonates, amine soaps, rosin soaps, naphthenic acids, and optional lubricating agents such as the sulfur, chlorine or phosphorous products available for this purpose.

The fluids of the present invention are useful in inhibiting corrosion in metalworking operations of ferrous metals and nonferrous metals such as copper or cupreous metals, aluminum and zinc. In all applications they can be prepared having the important qualities enumerated above. It has been found that the addition of one or more molybdate compounds, that is, compounds such as sodium molybdate which supply the desired amount of molybdate ($MoO_4^{-2}$) in water, to metalworking fluids containing the corrosion inhibitors described below reduces the amount needed of such inhibitors.

It has been discovered that the presence of a small amount of molybdate, together with a second compound or combination of compounds chosen from a group of compounds discussed below, when solubilized in a water-based metalworking fluid, gives an unexpected degree of corrosion inhibition of the surfaces of the metalworking piece, tool and machine elements. This is a particularly surprising discovery because molybdate compounds used separately without the presence of the second compound are not as effective for corrosion inhibition in the concentrations discussed here when used in metalworking operations on grey cast iron.

A satisfactory molybdate compound is any which will solubilize in water to the extent necessary to make available molybdate anions in the concentration disclosed here. Particularly advantageous molybdate compounds are sodium molybdate or sodium molybdate dihydrate, which are available commercially and are readily soluble in water. While the water-based metalworking fluid can contain $MoO_4^{-2}$ anion at a concentration from about 0.03 to 1.3 wt. % or sodium molybdate dihydrate at from about 0.05 to 2.0 wt. %, it is preferred to employ 0.07 to 0.66 wt. % of the molybdate anion or sodium molybdate dihydrate at from 0.1 to 1.0 wt. % for effective corrosion inhibition and efficient reagent consumption. Surprisingly, satisfactory corrosion inhibition is exhibited with $MoO_4^{-2}$ concentrations of 0.3 wt. % or less, or sodium molybdate dihydrate concentrations of 0.5 wt. % or less.

The group of compounds one or more of which are incorporated into water-based metalworking fluids together with the molybdate compound includes nitrites, borates, alkanolamines, amine borates, amine salts of unsaturated fatty acids, alkanolamine sarcosinates, alkanolamine phosphates, and alkali, morpholine, and alkanolamine salts of arylsulfonamido carboxylic acids. Particular compounds which are suitable are set forth below.

The nitrites can be supplied by sodium nitrite ($NaNO_2$) or other nitrite compounds soluble in water. When the corrosion inhibitor of the metalworking fluid of the present invention is molybdate plus nitrite, the concentration of nitrite in the fluid is about 0.02 to about 1.5 wt. %, and advantageously about 0.02 to about 1.0 wt. %. Surprisingly, very satisfactory corrosion inhibition is exhibited by metalworking fluids within the scope of the present invention containing only very small amounts of nitrite, that is, less than about 0.5 wt. % and even about 4.0 wt. % or less.

The borate which is used in combination with molybdate in the present invention can be supplied by sodium tetraborate or as a water soluble metaborate or orthoborate compound. When the corrosion inhibitor in the metalworking fluid of the present invention is molybdate plus borate, the concentration of borate in the fluid is about 0.05 to about 1.5 wt. % and advantageously about 0.05 to about 1.0 wt. %.

Alkanolamines which are used in combination with molybdate in the present invention include mono-, di- and triethanolamine, or a combination of two or all three of these alkanolamines. When the corrosion inhibitor in the metalworking fluid of the present invention is molybdate plus alkanolamine, the concentration of alkanolamine in the fluid is about 0.02 to about 1.5 wt. %, and advantageously about 0.1 to about 1.0 wt. %. Surprisingly, very satisfactory corrosion inhibition is exhibited by metalworking fluids within the scope of the present invention containing only small amounts of alkanolamine, that is, about 0.5 wt. % or less and even less than about 0.4 wt. %.

The amine borates used in combination with molybdate in the present invention comprise compounds wherein the borate is an addition compound or salt of an amine which is substituted with from 1 to 3 aliphatic radicals. Each aliphatic radical contains from 1 to 4 carbon atoms and is either unsubstituted or substituted with one or more hydroxyl groups. Examples of suitable amine borates include alkanolamine borates such as mono-, di- and triethanolamine borates. When the corrosion inhibitor in the metalworking fluid of the present invention is molybdate plus amine borate, the concentration of amine borate in the fluid is about 0.1 to about 2.0 wt. %, and advantageously about 0.1 to about 1.5 wt. %. Surprisingly, very satisfactory corrosion inhibition is exhibited by metalworking fluids within the scope of the present invention containing about 0.5 wt. % or less of amine borate.

The amine salts of unsaturated fatty acids which are used in combination with molybdates in the present invention, comprise amine-fatty acid compounds in which the amine is substituted with 1 to 3 aliphatic radicals. Each aliphatic radical contains 1 to 4 carbon atoms and is either unsubstituted or substituted with one or more hydroxyl groups. The unsaturated fatty acid portion of the compound contains 18 to 22 carbon atoms. Satisfactory fatty acids include oleic, linoleic, linolenic and ricinoleic acids. A particularly advantageous amine-fatty acid compound in the practice of this invention is triethanolamine oleate. When the corrosion inhibitor in the metalworking fluid of the present invention is molybdate plus an amine salt of an unsaturated fatty acid as described herein, the concentration of the amine salt of the unsaturated fatty acid is about 0.1 to about 2.0 wt. %, and advantageously about 0.1 to about 1.5 wt. %, and can surprisingly be as low as about 0.1 to about 0.5 wt. %.

The alkanolamine sarcosinates that can be used in combination with molybdate in the present invention include triethanolamine N-lauroyl sarcosinate and mono-, di- and triethanolamine sarcosinate. When the corrosion inhibitor in the metalworking fluid of the present invention is molybdate plus alkanolamine sarcosinate, the concentration of the alkanolamine sarcosinate in the fluid is about 0.1 to about 1.5 wt. % and advantageously about 0.1 to about 1.0 wt. %.

The alkanolamine phosphates that can be used in combination with molybdate in the present invention can be supplied as mono-, di- and triethanolamine phosphate. When the corrosion inhibitor in the metalworking fluid of the present invention is molybdate and alkanolamine phosphate, the concentration of the alkanolamine phosphate in the fluid is about 0.1 to about 1.5 wt. %, advantageously about 0.1 to about 1.0 wt. %, and surprisingly effective corrosion inhibition can be achieved within the present invention with as little as up to about 0.5 wt. %.

Water-soluble, alkali, morpholine and mono-, di- or triethanolamine salts of arylsulfonamido carboxylic acids can also be used in combination with molybdates in the present invention. When the corrosion inhibitor in the metalworking fluid of the present invention is molybdate plus the alkali, morpholine or alkanolamine salt of arylsulfonamido carboxylic acid, the concentration of the latter salt is about 0.1 to about 1.5 wt. % and advantageously about 0.1 to about 1.0 wt. %, and surprisingly effective at about 0.1 to about 0.5 wt. %.

It should also be noted that the corrosion inhibiting fluid of the present invention also includes fluids containing molybdate plus compounds selected from two or more of the groups of compounds discussed above (such as, molybdate-nitrite-alkanolamine; molybdate-fatty acid amineamine borate; and the three-component corrosion inhibiting systems shown in the Examples). When compounds from more than one of the groups discussed above are combined with molybdate in a metalworking fluid according to the present invention, each compound can be used in an amount falling within the range corresponding to that compound as set forth in the foregoing paragraphs.

For each of the above corrosion inhibiting metalworking fluids, the presence of the molybdate unexpectedly enhances the corrosion inhibition effectiveness of the other corrosion inhibiting compound or compounds in the metalworking fluid. Furthermore, the other compound or compounds unexpectedly enhances the corrosion inhibition effect of the molybdate compound. Thus, it is believed that the corrosion inhibition effectiveness of the present invention represents a synergistic combination of the corrosion inhibiting components which are combined in the fluid.

Other optional additives familiar to those skilled in this art can be incorporated in the metalworking fluids prepared in accordance with the present invention without impairing the corrosion inhibiting effectiveness of the invention. Such additives include, for instance, biocidally active agents, lubricity agents, anti-foaming agents, dispersants and wetting agents. In addition, for a metalworking fluid which is to be used to inhibit corrosion of aluminum surfaces in metalworking operations, it is often desirable to incorporate into the fluid chromate ion, in an amount such as about 0.01 to about 0.1 wt. % effective to further protect the aluminum surface against corrosion.

The pH of the metalworking fluid of this invention is generally in the range of about 8 to about 10, and advantageously about 8.5 to about 9.5 for effective corrosion inhibition. The natural pH of the combination of corrosion inhibitor compounds and optional additives in the metalworking fluid is usually in this range. However, if the fluid is below about pH 8 or above about pH 10, alkaline or acidic water-soluble, non-corrosive substances are incorporated in the fluid to adjust the pH range to between about 8 to about 10.

The invention will be described in the following examples, which are for illustrative purposes and should not be interpreted as limiting the scope of the present invention.

EXAMPLE 1

The corrosivity of a given fluid formulation for iron was determined by a cast iron chips corrosion test which was specifically designed to evaluate the corrosion protection afforded by metalworking fluids. This test uses gray cast iron chips, produced by the dry shaper machining of a gray cast iron ingot, which were cleaned in acetone and then dried. About 8 g of dry chips are placed in a 50 ml glass beaker and covered with 30 ml of the test fluid for 15 minutes. The fluid is then decanted and the wet chips are spread uniformly on a 9 cm Whatman No. 1 filter paper on a glass plate. The chips, paper and plate assembly is transferred to a closed cabinet maintained at a relative humidity of 80 to 90% at room temperature. After 4 hours, the wet chips are discarded and the filter paper is dried under ambient conditions. The extent of rust spotting on the paper is used to measure the corrosivity of the fluid. A corrosivity rating of 1 is given for no rust spotting, a rating of 2 is given for slight spotting, and a rating of 3 is given for gross rusting of the chips. Tests are performed in triplicate for each fluid and results are averaged. The fluids were made up by adding given amounts of one or more compounds to given amounts of synthetic low hardness water of high chloride and sulfate concentrations, simulating a relatively highly corrosive water supply. The composition of this water is given in Table I.

TABLE I

| Low Hardness Water | |
|---|---|
| Component | Concentration, mg/l |
| Chloride (as $Cl^-$) | 250 |
| Sulfate (as $SO_4^{-2}$) | 520 |
| Calcium (as $CaCO_3$) | 25 |
| Magnesium (as $CaCO_3$) | 15 |
| Sodium Bicarbonate* | 170 |
| Sodium Carbonate* | 25 |

TABLE I-continued

| Low Hardness Water | |
|---|---|
| Component | Concentration, mg/l |
| Deionized Water | Balance |

*to buffer water to pH 8.5

The following Table II correlates the amount(s) of corrosion inhibiting components with the corrosivity rating obtained in the cast iron chips corrosion test described above.

TABLE II

| Cast Iron Chips Corrosion Test | | | | | | | | | | | | | | | | | | | | | | |
|---|---|---|---|---|---|---|---|---|---|---|---|---|---|---|---|---|---|---|---|---|---|---|
| Compound | Concentration, wt. % | | | | | | | | | | | | | | | | | | | | | |
| Sodium molybdate dihydrate | 0.5 | | 0.3 | | | 0.2 | | 0.2 | | 0.5 | | 0.5 | | 0.5 | | | 0.5 | | | 0.3 | 0.5 | |
| Sodium nitrite | | 0.8 | 0.4 | | 0.8 | 0.4 | | | | | | | | | | | | | | | | |
| Triethanolamine | | | | 0.4 | 0.4 | 0.2 | | | | | | | | | | 1.0 | 0.5 | | 1.0 | 0.3 | 0.3 | |
| Sodium tetraborate decahydrate | | | | | | | 1.0 | 1.0 | | | | | | | | | | | | | | |
| Monoethanolamine borate | | | | | | | | | 1.0 | 0.5 | | | | | | | | | | | | |
| Triethanolamine oleate | | | | | | | | | | | 1.0 | 0.5 | | | | | | | | | | |
| Triethanolamine-N-lauroyl sarcosinate | | | | | | | | | | | | | 1.0 | 0.5 | | | | | | | | |
| Triethanolamine phosphate | | | | | | | | | | | | | | | 1.0 | 1.0 | 0.5 | | | | | |
| Sodium benzenesulfonamido acetate | | | | | | | | | | | | | | | | | | 1.0 | 1.0 | 0.5 | | |
| CORROSIVITY RATING | 3 | 2 | 1 | 3 | 2 | 1 | 3 | 2 | 3 | 1 | 3 | 2 | 3 | 2 | 3 | 3 | 1 | 3 | 3 | 1 | 2 | |

EXAMPLE 2

The corrosivity of metalworking fluids against aluminum, steel, hot-dip galvanized zinc, copper, and brass (70 Cu/30 Zn) was determined by polishing, scrubbing and drying coupons (70×12×2 mm) of the particular metal, and then placing the coupon vertically in a glass vial containing sufficient test fluid to cover about half the coupon. The vial is stoppered, inverted several times to completely wet the coupon, and then allowed to stand for 48 hours at room temperature with the stopper removed. The coupon is then removed, rinsed with methanol, dried without wiping, and visually compared with a similarly polished but untested coupon of the same metal. A surface change or color change at or below the atmosphere-fluid interface is reported as a failure of the fluid tested to inhibit corrosion. Table III reports the results of this corrosivity test.

TABLE III

| Fluid Corrosivity to Metal Coupons | | | | | | | | | | | | |
|---|---|---|---|---|---|---|---|---|---|---|---|---|
| Compound | Concentration, wt. % | | | | | | | | | | | |
| Sodium molybdate dihydrate | 0.5 | | 0.3 | | | 0.2 | | 0.5 | | 0.5 | | 0.5 |
| Sodium nitrite | | 0.8 | 0.4 | | 0.8 | 0.4 | | | | | | |
| Triethanolamine | | | | 0.4 | 0.4 | 0.2 | | | | | | |
| Monoethanolamine borate | | | | | | | 1.0 | 0.5 | | | | |
| Sodium benzenesulfonamido acetate | | | | | | | | | 1.0 | 0.5 | | |
| Triethanolamine-N-lauroyl sarcosinate | | | | | | | | | | | 1.0 | 0.5 |
| Fluid effect on metal coupons: Pass = +, Fail = − | | | | | | | | | | | | |
| Low carbon steel | + | + | + | − | + | + | − | + | + | + | − | + |
| Aluminum | + | − | + | − | − | + | − | − | − | + | − | + |
| Hot-dip galvanized zinc | + | − | + | − | − | + | + | + | + | + | − | + |
| Copper | + | + | + | − | + | + | − | + | + | + | + | + |
| Brass (70 Cu-30 Zn) | + | + | + | − | + | + | − | + | + | + | + | + |

We claim:

1. A metalworking fluid comprising an aqueous solution or an oil-water emulsion, which inhibits corrosion of metal surfaces which the fluid contacts during a metalworking operation, the fluid having a pH value between about 8 and about 10 and containing dissolved in water a corrosion inhibitor consisting essentially of about 0.5% by weight monoethanolamine borate and about 0.3% by weight $MoO_4^{-2}$ anion.

2. A metalworking fluid comprising an aqueous solution or an oil-water emulsion, which inhibits corrosion of metal surfaces which the fluid contacts during a metalworking operation, the fluid having a pH value between about 8 and about 10 and containing dissolved in water a corrosion inhibitor consisting essentially of about 1% by weight triethanolamine oleate and about 0.6% by weight $MoO_4^{-2}$ anion.

3. A metalworking fluid comprising an aqueous solution or oil-water emulsion, which inhibits corrosion of metal surfaces which the fluid contacts during a metalworking operation, the fluid having a pH value between about 8 and about 10 and containing dissolved in water a corrosion inhibitor consisting essentially of about 0.5% triethanolamine phosphate and about 0.3% by weight $MoO_4^{-2}$ anion.

* * * * *